US006181059B1

(12) United States Patent
Beeteson

(10) Patent No.: US 6,181,059 B1
(45) Date of Patent: Jan. 30, 2001

(54) ELECTRON SOURCE HAVING A PLURALITY OF MAGNETIC CHANNELS

(75) Inventor: John Stuart Beeteson, Skelmorlie (GB)

(73) Assignee: International Business Machines Corporation, Armonk, NY (US)

( * ) Notice: Under 35 U.S.C. 154(b), the term of this patent shall be extended for 0 days.

(21) Appl. No.: 09/198,293

(22) Filed: Nov. 23, 1998

(30) Foreign Application Priority Data

Sep. 3, 1998 (GB) ..... 9819213

(51) Int. Cl.[7] ..... H01J 29/70

(52) U.S. Cl. ..... 313/422; 313/495; 313/431; 345/19

(58) Field of Search ..... 313/422, 495, 313/431; 345/13

(56) References Cited

U.S. PATENT DOCUMENTS

| | | | | |
|---|---|---|---|---|
| 5,227,691 | | 7/1993 | Murai et al. . | |
| 5,844,354 | * | 12/1998 | De Zwart et al. | 313/422 |
| 5,857,883 | * | 1/1999 | Knickerbocker et al. | 445/23 |
| 5,959,397 | * | 9/1998 | Lambert et al. | 313/422 |

FOREIGN PATENT DOCUMENTS

| | | | |
|---|---|---|---|
| 0 213 839 | 3/1987 | (EP) | H01J/31/12 |
| 0399515 | 5/1990 | (EP) | H01J/31/12 |
| 0522544 | 7/1992 | (EP) | H01J/31/12 |

* cited by examiner

*Primary Examiner*—Nimeshkumar D. Patel
*Assistant Examiner*—Karrabi Guharay
(74) *Attorney, Agent, or Firm*—David M. Shofi

(57) ABSTRACT

An electron source comprises a first permanent magnet having a first channel, extending between first and second poles of the magnet, the internal surfaces of the first channel being conductive. A cathode means is located in the first channel at a first pole of the magnet, a potential being applied between the cathode means and the conductive internal surfaces of the first channel causing electrons to be received into the first channel. A plurality of apertures is located on a wall of the first channel, the wall abutting a second permanent magnet having a plurality of second channels extending between first and second poles of the second magnet. The second pole of the second permanent magnet is adjacent to the aperture located on a wall of the first magnet such that electrons received into the first channel are distributed into the plurality of second channels.

18 Claims, 7 Drawing Sheets

ELECTRON SOURCE HAVING A PLURALITY OF MAGNETIC CHANNELS

TECHNICAL FIELD OF THE INVENTION

The present invention relates to an area cathode suitable for use in a flat panel display and more particularly to an area cathode in which electrons are confined in magnetic channels and extracted by low voltage electrostatic fields and which uses a conventional CRT cathode as a source of electrons.

BACKGROUND OF THE INVENTION

An area cathode of the present invention is particularly although not exclusively useful in display applications, especially flat panel display applications. Such applications include television receivers and visual display units for computers, especially although not exclusively portable computers, personal organisers, communications equipment, and the like.

All flat panel CRT technologies require an area cathode, that is a uniform planar source of electrons the same area as the display. There have been many designs developed over the years, based on technologies such as Field Emission Devices (FEDs), Metal-Insulator-Metal devices (MIMs) and the like. Probably the most successful types have been the virtual thermionic cathode from Source Technology, disclosed in European Patent Application 0 213 839, and the secondary emission channel hopping cathode developed by Philips for their Zeus display. All current designs, however, suffer from significant disadvantages of one sort or another. In particular the virtual thermionic type has high power and hence a major heat dissipation problem, and the channel hopping type has high and non uniform channel extraction voltages.

U.S. Pat. No. 5,227,691 discloses a flat tube display apparatus in which a row of many electron beam generators is arranged transversely in a thin flat vacuum tube body to generate a number of beams in parallel with each other which travel in parallel with an image screen and in which the electron beam generators are arranged to deflect the beams toward the image screen at a predetermined position. The beams are guided without being widely diverged due to the provision of a number of side walls arranged in parallel with each other to confine the beams and due to the provision of alternately strong and weak magnetic fields along the side walls forming periodic magnetic lenses. The electron beams are deflected electrostatically or using a magnetic field towards an electron beam multiplier and a phosphor screen.

It would be desirable to produce an area cathode that has:

1. An electron source based on known materials;
2. Generation of electrons at a low eV (hence low extraction voltages);
3. A narrow eV spread (hence low beam spreading);
4. A high degree of uniformity;
5. Low power and heat;
6. Isolation from external electric and magnetic fields;
7. Protection of the electron source from ion bombardment; and
8. Mechanical simplicity leading to low cost.

SUMMARY OF THE INVENTION

Accordingly, the invention provides an electron source comprising a first permanent magnet having a first channel, extending between first and second poles of the magnet, the internal surfaces of the first channel being conductive, a cathode means located in the first channel at a first pole of the magnet, a potential being applied between the cathode means and the conductive internal surfaces of the first channel causing electrons to be received into the first channel, and a plurality of apertures located on a wall of the first channel, the wall abutting a second permanent magnet having a plurality of second channels extending between first and second poles of the second magnet, the second pole of the second magnet being adjacent to the apertures located on said wall of the first magnet, such that electrons received into the first channel are distributed into the plurality of second channels. This arrangement has the advantage that a single conventional CRT cathode can be used as an electron source to generate a single electron beam, which is then split so that substantially similar proportions of the beam are directed into closed channels formed in a flat magnet.

Preferably, regions of the internal conducting surfaces of the first channel are isolated, the isolated regions having voltages applied to them to create electrostatic lenses for the purpose of directing the electrons at junctions between the first channel and the plurality of second channels. The use of electrostatic lenses for directing the electrons at junctions reduces the loss of electrons to the conducting walls of the channels. Some of the electrons would otherwise tend to be attracted to the walls because some of the lines of magnetic flux along which the electrons travel are angled and meet the walls of the channel.

In a preferred embodiment, the internal surfaces of each of the second channels are conductive, each of the second channels having a plurality of perforations located on the first surface of the second magnet, the surface extending between opposite poles of the magnet, wherein each perforation forms electrons received from the cathode means into an electron beam for guidance towards a target. The electrons which are formed into a beam in the first channel are split into a plurality of beams in the second channels and each of those beams is then split into a plurality of beams exiting through each of the perforations, to form a grid of electrons beams, which may be individually controlled as is known in the art. Thus the invention provides such a grid array of electron beams from a single conventional cathode source.

In a further embodiment, the electron source further comprises a third permanent magnet having a third channel, extending between first and second poles of the magnet, the internal surfaces of the third channel being conductive and a plurality of apertures located on a wall of the third channel, the wall abutting the second magnet, the first pole of the second magnet being adjacent to the apertures located on said wall of the third magnet. The third permanent magnet provides a balancing channel, which helps to linearize the magnetic field lines in the plurality of second channels such that they are not angled towards the walls. This substantially prevents the electrons being deflected into the walls by angled lines of flux.

Optionally, the electron source further comprising a cathode means located in the third channel at a second pole of the third magnet, a potential being applied between the cathode means and the conductive internal surfaces of the third channel causing electrons to be received into the third channel. Such a configuration provides a higher beam current availability.

Preferably, the second channels are arranged at a pitch corresponding to the pixel pitch of a display incorporating the electron source. This provides a single source of electrons for each of the pixels of a display incorporating the electron source.

Preferably, each second channel has a constant cross-section along its length.

In a preferred embodiment, the second magnet comprises a first magnetic plate having grooves, extending between opposite poles of the magnet, along a first surface of the first magnetic plate, and a second magnetic plate having a plurality of perforations, said second plate being located so as to close the grooves to form the plurality of second channels, the second channels having perforations located on a surface extending between opposite poles of the second magnet. Manufacture of the second magnet in two parts enables standard mass production processes to be used for the forming of the grooved plate and for the provision of the thin conducting coatings on the internal surfaces of the closed channels.

Preferably, the first magnetic plate is at least twice as thick as the channel depth. This has the advantage that the flux density is increased within the channel, so increasing the isolation from external fields. This also has the advantage that null field points and non-linearities present in the channel are moved into the perforations. This provides an essentially linear field in the channels, with no field reversals.

Preferably, each channel has a depth greater than the width of the channel and wherein the portion of the channel furthest from the perforations is curved in cross-section. This has the advantage of increasing the volume of magnetic material on the non-perforated side of the magnet plate.

In a preferred embodiment wherein each channel is quadrilateral in cross-section, or further preferably, each channel is square in cross-section. This has the advantage of making the manufacture of a magnet plate having grooves particularly suited to conventional mass production techniques.

Preferably, the perforations are disposed in the magnet in a two dimensional array of rows and columns.

Preferably, the perforations are arranged at a pitch corresponding to the pixel pitch of a display incorporating the electron source. This provides a single source of electrons for each of the pixels of the display incorporating the electron source.

Preferably, each of said channels is unperforated for a distance from the first channel of ten or more times the pitch of the perforations. This unperforated distance means that the magnetic field is linear over a sufficiently long distance so as to allow collimation of the electrons to become established.

Preferably, the electron source further comprises a stainless steel plate located on the surface of the magnet furthest from the perforations. The use of a non-magnetic stainless steel plate gives the magnet assembly increased tensile strength.

In a variation of the preferred embodiment, the conducting surfaces associated with each of the channels are electrically separated. Since the current that enters each of the channels is all absorbed by the channel walls during the display blanking periods, by arranging for separate connection of each channel conducting surface, emission control on a channel by channel basis may be provided.

The invention also provides a display device comprising: an electron source as described above; a screen for receiving electrons from the electron source, the screen having a phosphor coating facing the side of the magnet having perforations; two perforated ceramic plates, each having a conductive surface, so as to cause a flow of electrons from the cathode to the phosphor coating via the channels and perforations thereby to produce an image on the screen.

BRIEF DESCRIPTION OF THE DRAWINGS

A preferred embodiment of the present invention will now be described, by way of example only, with reference to the accompanying drawings in which.

DETAILED DESCRIPTION OF THE INVENTION

The present invention will now be described with reference to an embodiment of the invention. The embodiment of a magnetic channel cathode uses a single conventional CRT low power thermionic filament type cathode.

Basic construction

Figure 1:
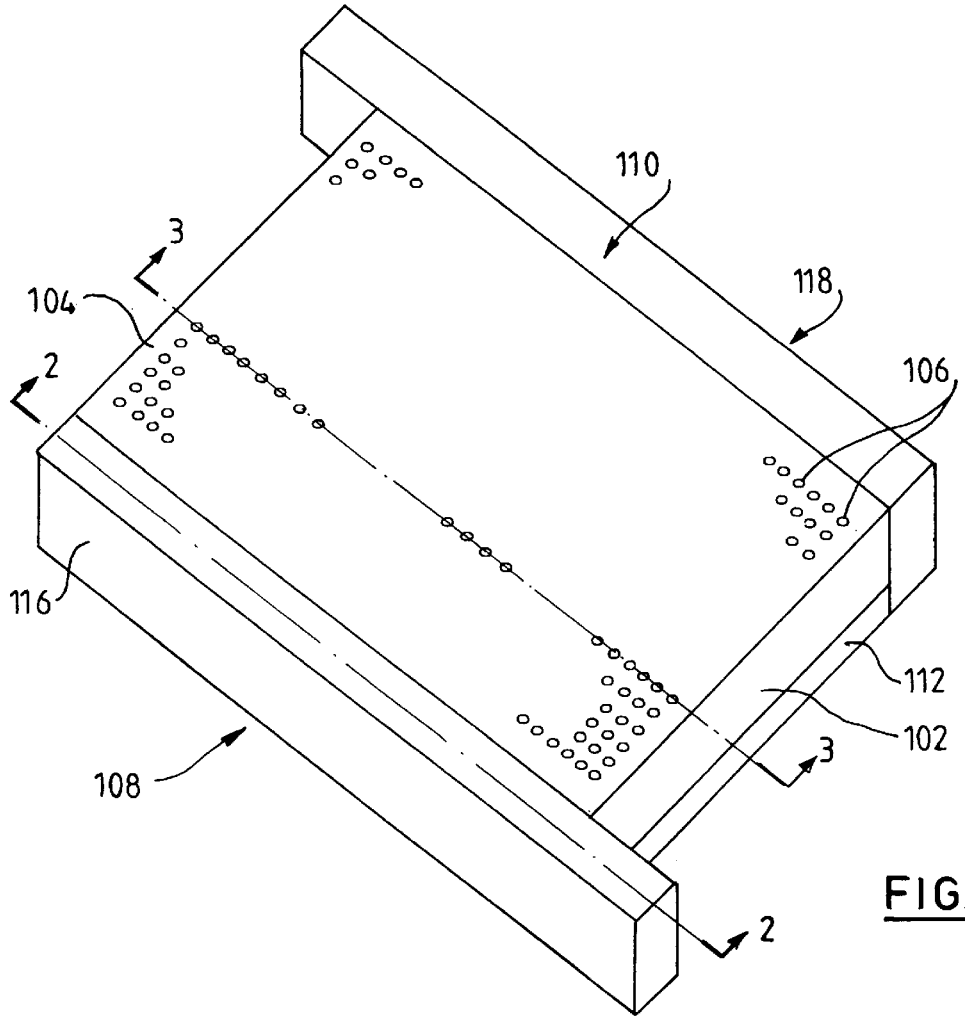
FIG. 1 is an isometric view of a magnetic channel cathode in which a conventional CRT cathode is used.

FIG. 1 illustrates an embodiment of a magnetic channel cathode of the present invention. The dimensions given are suitable for use in a 0.3 mm pixel pitch high resolution display and are given for exemplary purposes only. For other pitches of display, different dimensions would be used. A first flat permanent magnet 102, 0.6 mm thick and the same area as the display, has grooves formed into the surface. Each groove is 0.3 mm pitch with walls 0.075 mm thick and channel depth 0.225 mm. The grooves run vertically assuming that a conventional row selection display is used. Over the top of this is placed a second flat permanent magnet 104, of thickness 0.075 mm. This second magnet 104 has the effect of forming the open grooves in the first magnet 102 into closed channels. The second magnet 104 is ungrooved and has a matrix of 0.15 mm perforations 106 machined through it at the 0.3 mm pixel pitch. There is a 10 mm strip at the top and at the bottom of the second magnet 104 which is left unperforated. The flat permanent magnet 102 is fixed to a stainless steel base plate 112.

At one end of the magnet is located a further magnetic channel 116 running perpendicular to the other channels in the magnet. The channel 116 has a conventional CRT cathode (206 in FIG. 2) placed at one end. An electron beam of approximately 300 $\mu$A is magnetically confined within the channel and travels down its length. Each of the channels in the magnet 102 has an open aperture at the end nearest channel 116. The magnetically confined electron beam is split such that an equal proportion of electrons is guided into each channel in magnet 102. The mechanism by which the splitting is achieved will be described later with reference to FIGS. 4 to 9. The walls of the magnetic channel 116 have a thin conductive coating to which a potential of typically 0 V is applied. A potential of typically −1 V is applied to the cathode (206 in FIG. 2) so that a basic thermionic diode is formed, and electrons will be drawn into the magnetic channel 116 from the cathode (206 in FIG. 2).

At the end of the magnet opposite the end where the channel 116 is located is a balancing channel 118. In FIG. 1, the balancing channel is shown extending from the magnet 102 in a direction opposed to that of the magnetic channel 116. The balancing channel 118 may also extend from the magnet 102 in the same direction as that of magnetic channel 116. The location of balancing channel 118 may be such that the structure is dimensionally symmetrical. The balancing channel 118 will be described later with reference to FIGS. 7 to 9.

The magnetic tunnel cathode structure is magnetised to form the north pole 108 at the top of the display and the south pole 110 at the bottom of the display. Methods of manufacturing and magnetising this structure based on existing processes will be described later.

A single conventional CRT cathode can easily supply all the current required in a Magnetic Channel Cathode display, especially if a dispenser cathode commonly used in high end conventional displays is used. If such a cathode is used as a single electron emission source in the present invention, the problems with conventional area cathodes of uniformity, high power and heat generation largely disappear. The total cathode power requirements drop to around 2 W which means that the whole display only requires under 10 W to operate.

Figure 2:
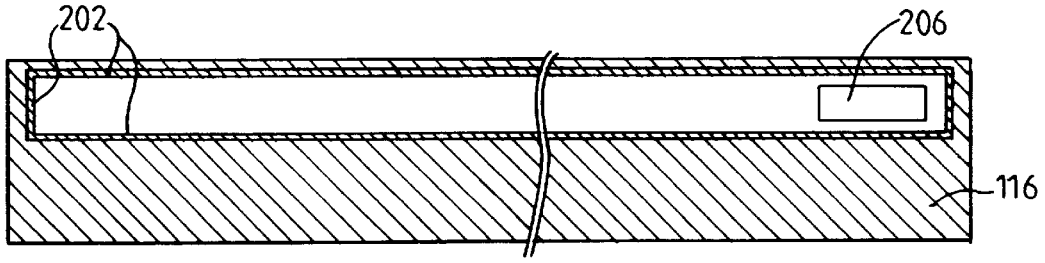
FIG. 2 is a cross-section view of the magnetic channel cathode of FIG. 1, the cross-section being taken at one end of the cathode, in the area of the channel 116.

FIG. 2 shows a cross-section view of the magnetic channel cathode of FIG. 1, the cross-section being taken at the channel 116. On the inside of the channel, the surfaces have a thin conductive coating 202. Cathode 206 is located at one end of the channel 116.

Figure 3:
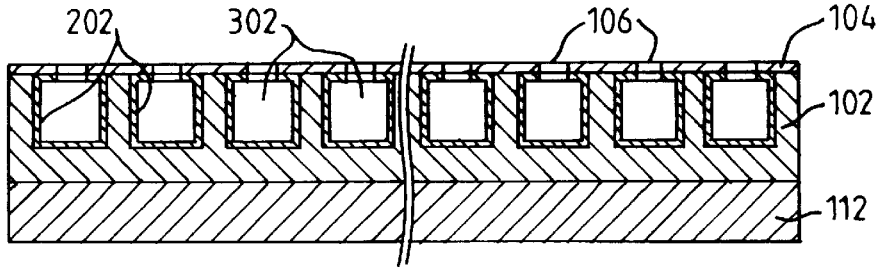
FIG. 3 is a cross-section view of the magnetic channel cathode of FIG. 1, the cross-section being taken at the central portion of the cathode.

FIG. 3 shows a cross-section of the magnetic channel cathode of FIG. 1, the cross-section being taken at the central portion of the cathode. Channels 302 can be seen in this cross-section view, as can the thin conductive coating 202. There are apertures 106 in top magnet plate 104 corresponding to each of the channels 302. These holes are repeated along each of the channels 302 at the 0.3 mm pixel pitch.

Before continuing further with the description of this embodiment, the magnetic field theory behind the mechanism which achieves the splitting of the electron beam from the channel 116 into the channels 302 of the magnet 102 will be briefly reviewed.

Solenoids

Figure 4:
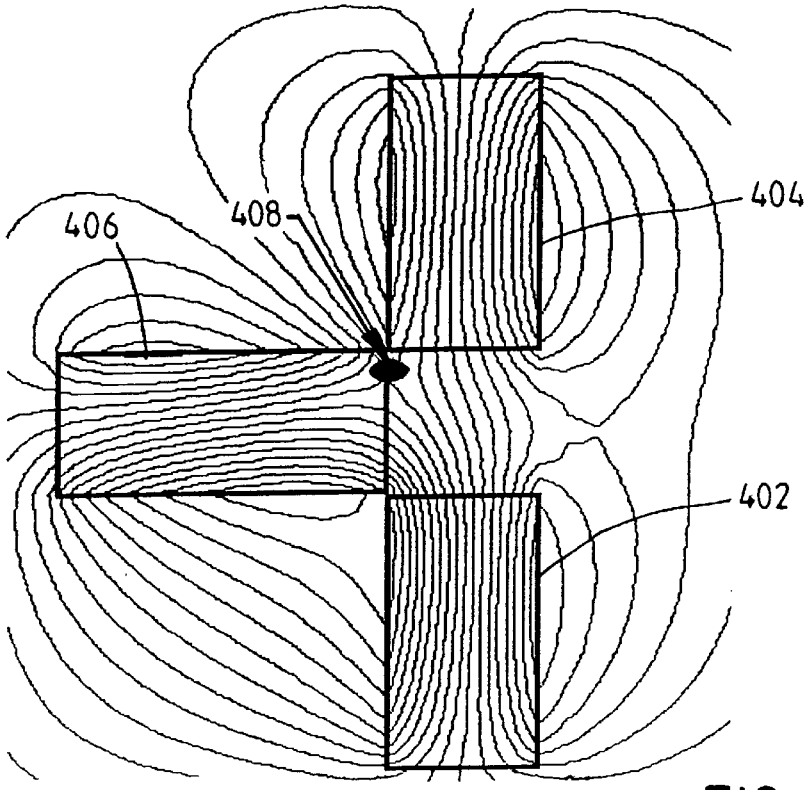
FIG. 4 shows the magnetic flux lines in three solenoids arranged in a T pattern.

Consider first the magnetic flux lines in three solenoids 402, 404, 406 arranged in a T pattern, as shown in FIG. 4. Substantially linear fields are generated along the axis of the solenoids, so that electrons spiral around the flux lines and are collimated, as has been demonstrated in the Magnetic Matrix Display. Consider flux lines starting at the bottom of solenoid 402 and directed upwards through solenoid 402. When the flux lines reach the top of solenoid 402, some of the flux lines continue into the upper solenoid 404 and some are deflected at right angles into the solenoid 406 on the left. Thus a wide beam of collimated electrons travelling upwards through the lower solenoid 402 is split between the other two solenoids 404, 406 at the T junction. A magnetic null region is produced at 408 where the flux density drops to a low value and field reversals take place.

Figure 5:
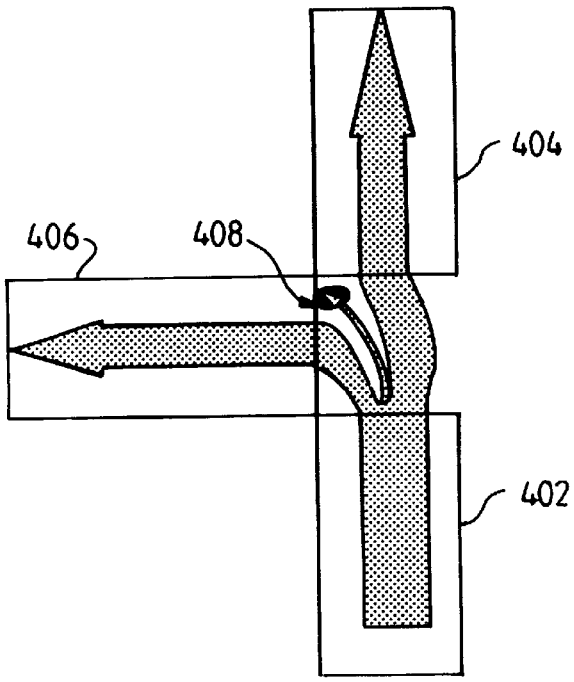
FIG. 5 shows a simplified schematic of the flux paths in the solenoids of FIG. 4.

FIG. 5 shows a simplified schematic of the flux paths. Solenoids only produce null regions where two solenoids meet. A single null region is produced at the point shown in FIG. 5, but it is not positioned where it is likely to have a significant effect on an electron beam following the lines of flux.

Permanent magnets

Figure 6:
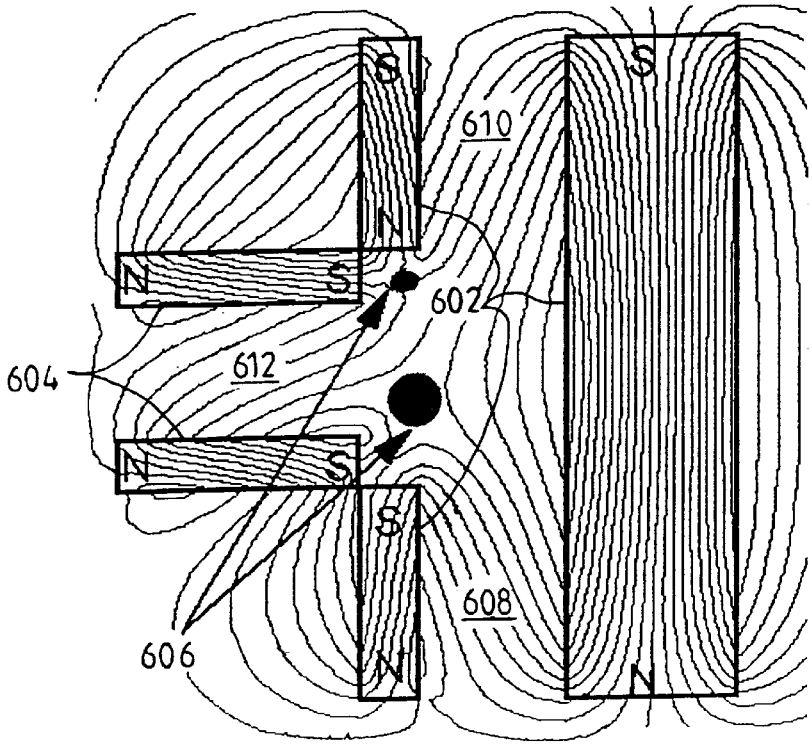
FIG. 6 shows the magnetic flux lines through channels in permanent magnets, the magnets being arranged to correspond to the solenoids of FIG. 4.

Magnetic fields through apertures in permanent magnets differ from the field down the centre of a solenoid in that null regions are produced at both entrance and exit. FIG. 6 shows the flux pattern through channel apertures when two magnets 602, 604 are positioned in a T arrangement. It can be seen that flux density in the aperture is lower than in FIG. 4, the field lines are angled to the channel walls and two large null regions 606 are produced at the T junction.

The angled flux lines in the regions denoted by reference numerals 608 and 610 (which is part of the long single channel for the primary beam produced from the CRT cathode) do not cause a problem. By simple superposition, when region 608 abuts region 610 the flux lines tend to linearize, and a "looping" pattern is produced. Electrons follow the flux lines and "loop" along the channel. However, the angled lines in the region denoted by reference numeral 612 are a problem as they will cause electrons to hit the channel walls. This can be corrected by applying a uniform electric field in a direction to oppose the direction of electron drift. Another way to correct this is to use a balancing magnet channel 118 at the other end of the channel plate.

Figure 7:
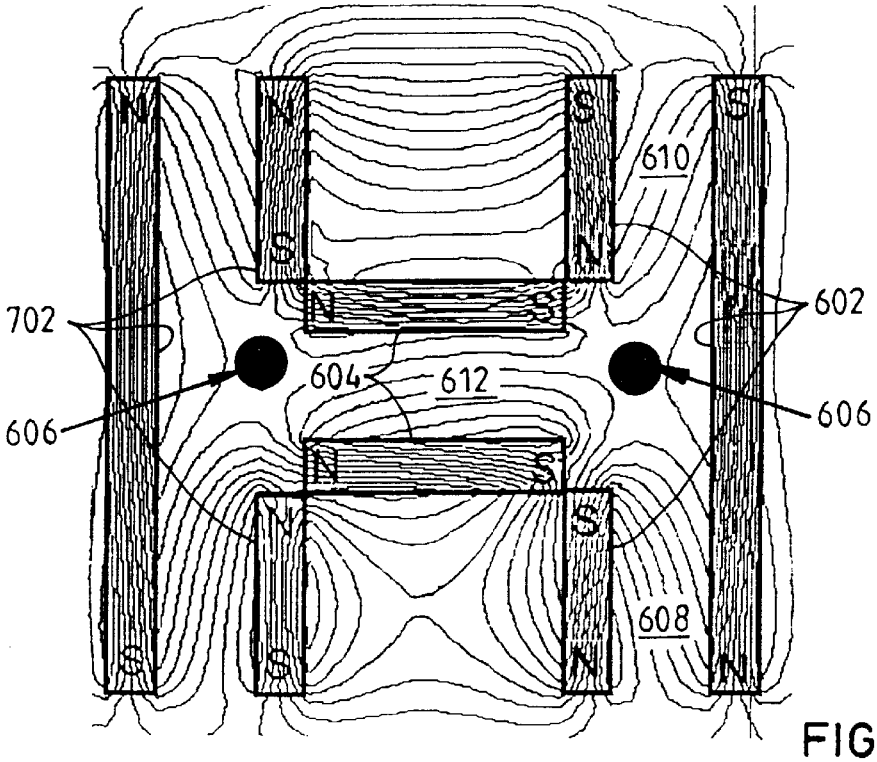
FIG. 7 shows the magnetic flux lines in a variation of FIG. 6, with the magnets arranged in a balanced configuration.

FIG. 7 shows such a balancing magnetic channel 702 and it can be seen that the fields in the region denoted by reference numeral 610 are now linear. In a variation of the preferred embodiment, a second emission source is placed in the balancing channel 702.

Figure 8:
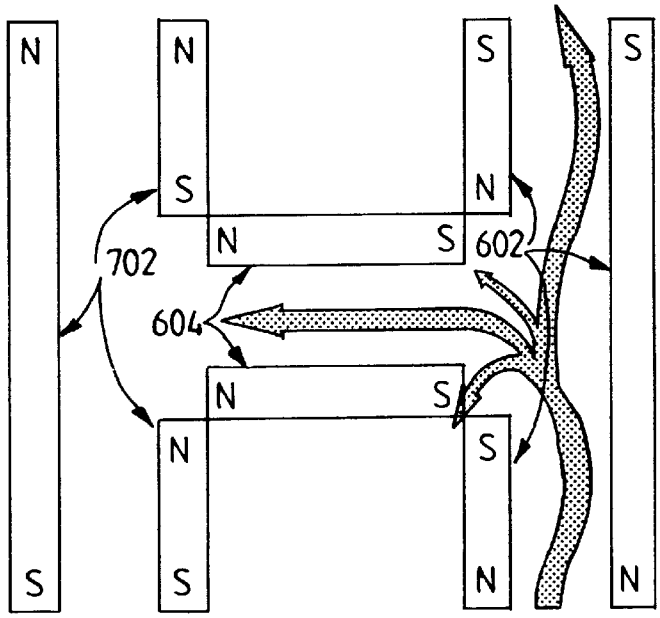
FIG. 8 shows a simplified schematic of the flux paths in the magnets of FIG. 7.
Figure 9:
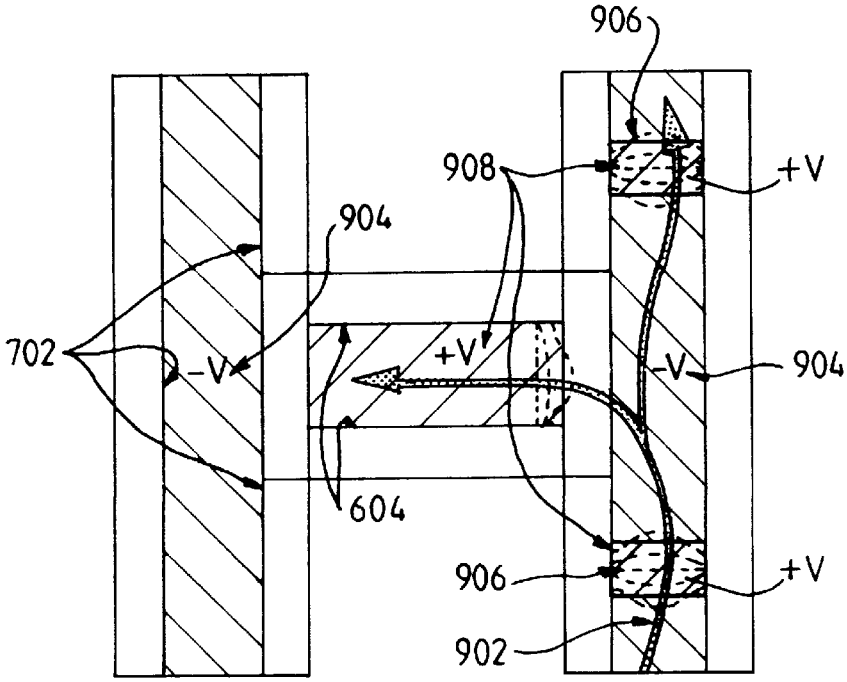
FIG. 9 shows the addition of positive and negative voltage regions to the magnets of FIG. 7 to provide additional electron steering into channels.

FIG. 8 shows a simplified schematic of the direction of the flux lines, also showing the looping nature of the field lines in the base channel 602. The direction of an electron when it enters a null region is indeterminate. Depending on its velocity and position it may continue down the main channel, be diverted into the second channel or hit the magnet wall. To eliminate any possibility of electron loss to the walls, electrostatic field regions are added to the channels, as shown in FIG. 9. The path of electrons influenced by the magnetic fields is shown by the reference numeral 902. Since the electron velocity is low, only low voltages are needed, typically only 1 or 2 volts in order to create well defined electrostatic lenses 906 that collect and direct all the electrons from the cathode. Once the electrons have been focused into the centre of the lenses then the magnetic fields take over and properly collimate the beams through the apertures. The areas 904 have a negative voltage applied whilst the areas 908 have a positive voltage applied. The areas 906 act as electrostatic lenses.

Thus a structure based on channels in permanent magnets and low voltage electric fields has been produced, that will create an electron splitting system similar to the solenoids shown in FIG. 4. By detailed design of the channel dimensions and shapes, and the placing and values of the voltages forming the electrostatic lenses, an appropriate proportion of the beam can be diverted into each channel of the Magnetic Channel Cathode plate.

For the purposes of the description of the basic operation of the device of FIG. 1, it will be assumed that a space charge limited point source of electrons is present at the entrance to each of the channels 302. the electron beam from cathode 206 has been split using the mechanisms described with reference to FIGS. 4 to 9 into beams of electrons associated with each of the channels 302. For the purposes of the description of the basic operation of the device, −1V will be placed on the cathode 204 and 0V on the magnet channel conducting surfaces 202.

Electron beam channelling

On entering the channel 302 the electrons encounter a magnetic field whose flux lines run parallel to the walls of the channels 302 down the length of the channel 302. Electrons spiral around such flux lines. Since the entire inner surface of each channel 302 is uniformly at 0V, this is an electrostatic field free volume, and there is no acceleration or retardation of the electrons, that is, they continue to spiral until they are absorbed by the end wall 114. The diameter and pitch of the spiral depends on the strength of the magnetic field and the electron velocity. Thus down the length of each channel 302 is created a source of electrons of low eV (1 eV nominal in this case) and uniform density.

The above description would be entirely correct if each channel 302 were magnetically totally enclosed, with equal wall thickness all round, However, the presence of apertures 106 perforating the front surface of the magnet channels 302 modifies the electron behaviour significantly.

Figure 10:
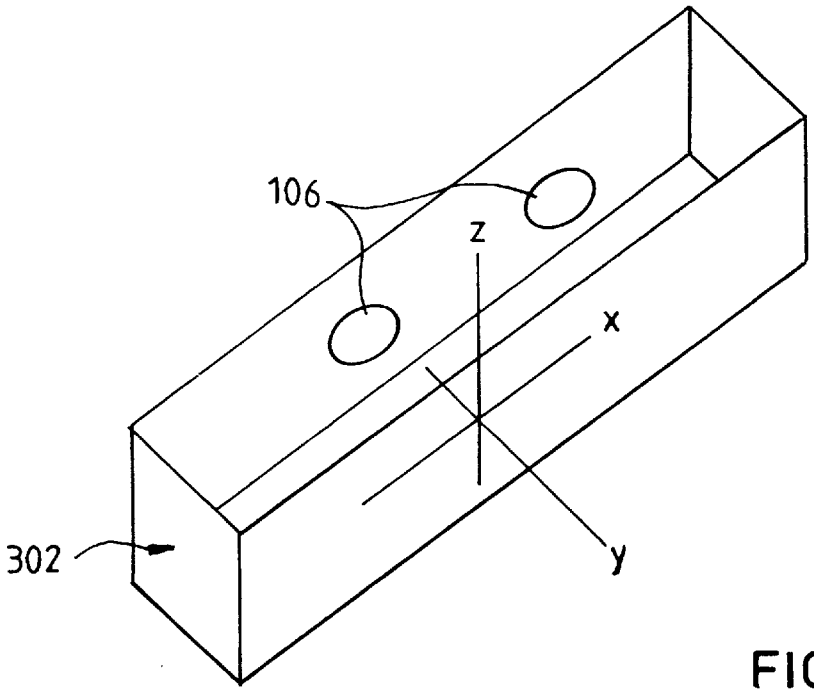
FIG. 10 is an isometric view of one of the closed channels in the magnetic channel cathode of FIG. 1, with the flux directions defined as they will be referred to in the subsequent figures.

FIG. 10 shows one of the closed channels 102 in the magnet 102 with the flux directions defined as they will be referred to in the subsequent figures.

Figure 11:
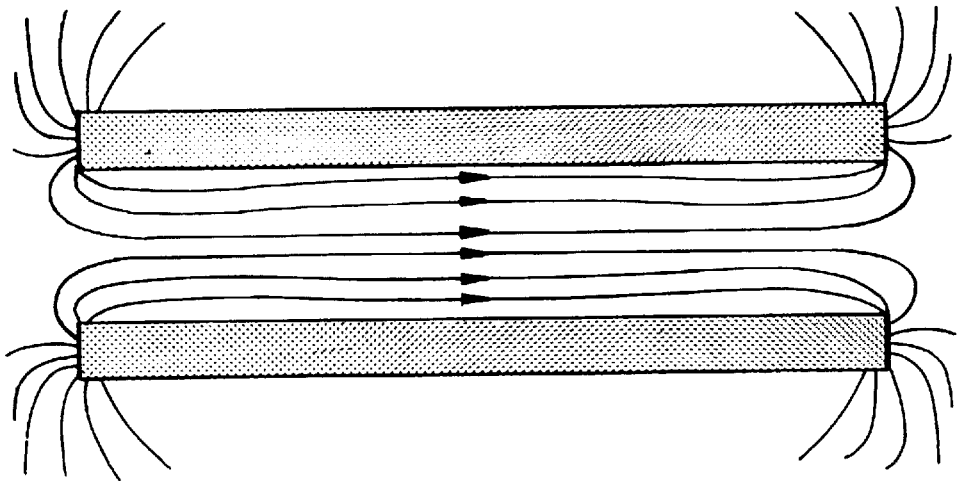
FIG. 11 is a cross-section view of the unperforated portion of the channels in the magnetic channel cathode of FIG. 1, showing X and Z directed flux lines.

FIG. 11 shows X and Z directed flux lines through a portion of a closed channel.

Figure 12:
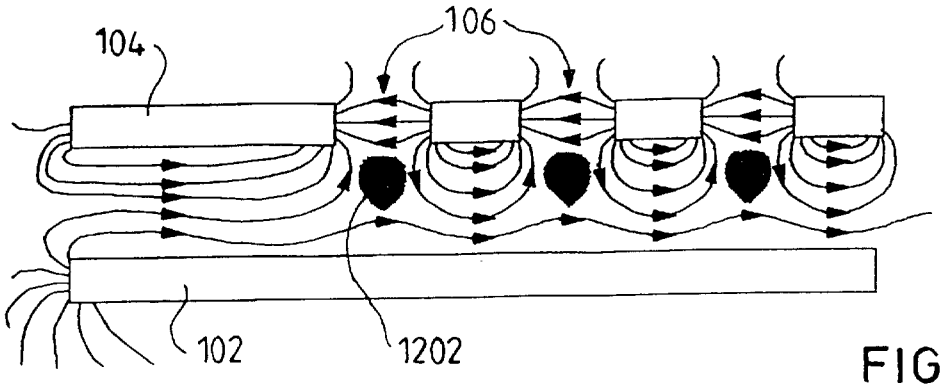
FIG. 12 is a cross-section view of the perforated portion of one of the closed channels in the magnetic channel cathode of FIG. 1, showing X and Z directed flux lines.

FIG. 12 shows X and Z directed flux lines through a portion of a perforated channel. Compared to the flux lines shown in FIG. 11 for the closed channel, the open apertures 106 cause flux reversals and a null field region 1202 under each aperture 106. The closer an electron is to the perforated surface 104 the more disturbed its path becomes and some electrons are eventually lost by absorption to the walls. Electrons furthest from the perforated surface 104 suffer the least disturbance. Finite element simulation reveals a more subtle effect in that the presence of the apertures 106 gives rise to a small net field in the Z direction, and because electrons move at right angles to a magnetic field this produces a gradual movement in the Y direction.

Figure 13:
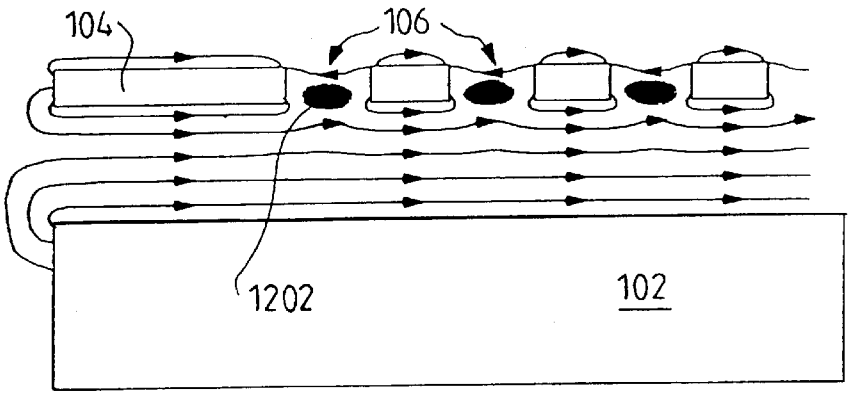
FIG. 13 is a cross-section view of the perforated channel of FIG. 13, modified so that the magnet plane 102 furthest from the apertures 106 is thicker.

FIG. 13 shows the perforated channel of FIG. 5, modified so that the magnet plane 102 furthest from the apertures 106 is thicker. This has two advantages, firstly the flux density is increased within the channel (so increasing the isolation from external fields), and secondly the null field points 602 and non linearities are moved into the perforated apertures. The field within the channel now becomes essentially linear, with no field reversals. The Z directed field and hence the sideways drift of electrons is much reduced.

Figure 14:
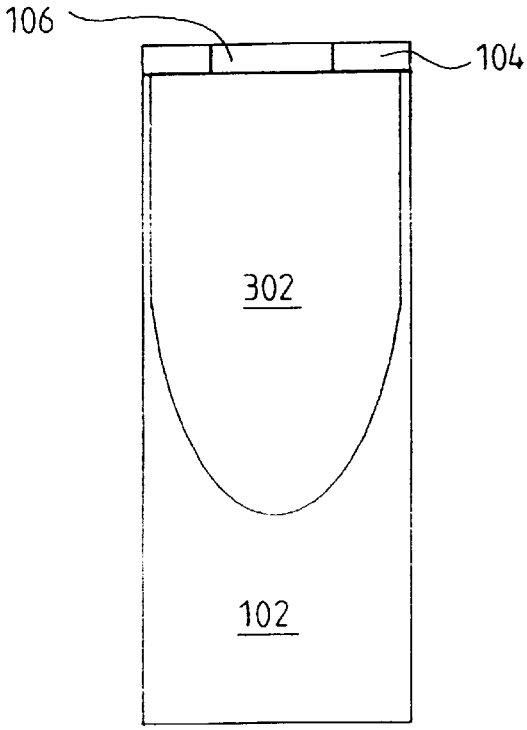
FIG. 14 is a cross-section view of a further variation of the perforated channel of FIG. 12, in which a curved and deeper channel cross-section is used.

FIG. 14 shows a cross-section view of a further variation of the perforated channel, in which a curved and deeper channel cross-section is used. This has the advantage that the volume of magnetic material towards the non perforated plate is increased. By adjustment of the material thickness, it is possible to obtain null regions which are entirely above the apertures, so presenting a very low disturbing field to extracted electrons.

Electron collection

At the entrance to the channel the electrons are automatically collimated by the magnetic field along the length of each channel 302. The magnetic field should be linear over a sufficient length of the channel 302 to allow collimation to become established. Typically, a linear (i.e. non perforated) region of about ten or more times the pixel pitch is sufficient. This dimension may vary with other parameters, but needs to be chosen such that collimation is established.

Electron extraction

To extract electrons from the channel 302 it is necessary to place an electric field over an aperture 106. Typically, +5V applied to electrodes located at the surface of an aperture 106 extracts all the electrons. With +1V applied at the aperture 106, only a proportion of the electrons are extracted. This simple low voltage extraction method modulates the beam in the required manner. It is the high energy electrons that are collected first (that is those electrons with the highest eV) and therefore this extraction method can also be used as an eV filter, selecting only those electrons with the desired energy.

The extracted electrons can be used by a number of different display types including a Magnetic Matrix Display, such as that disclosed in UK Patent Application 2304981. This patent application discloses a magnetic matrix display having a cathode for emitting electrons, a permanent magnet with a two dimensional array of channels extending between opposite poles of the magnet, the direction of magnetisation being from the surface facing the cathode to the opposing surface. The magnet generates, in each channel, a magnetic field for forming electrons from the cathode means into an electron beam. The display also has a screen for receiving an electron beam from each channel. The screen has a phosphor coating facing the side of the magnet remote from the cathode, the phosphor coating comprising a plurality of stripes per column, each stripe corresponding to a different channel.

Figure 15:
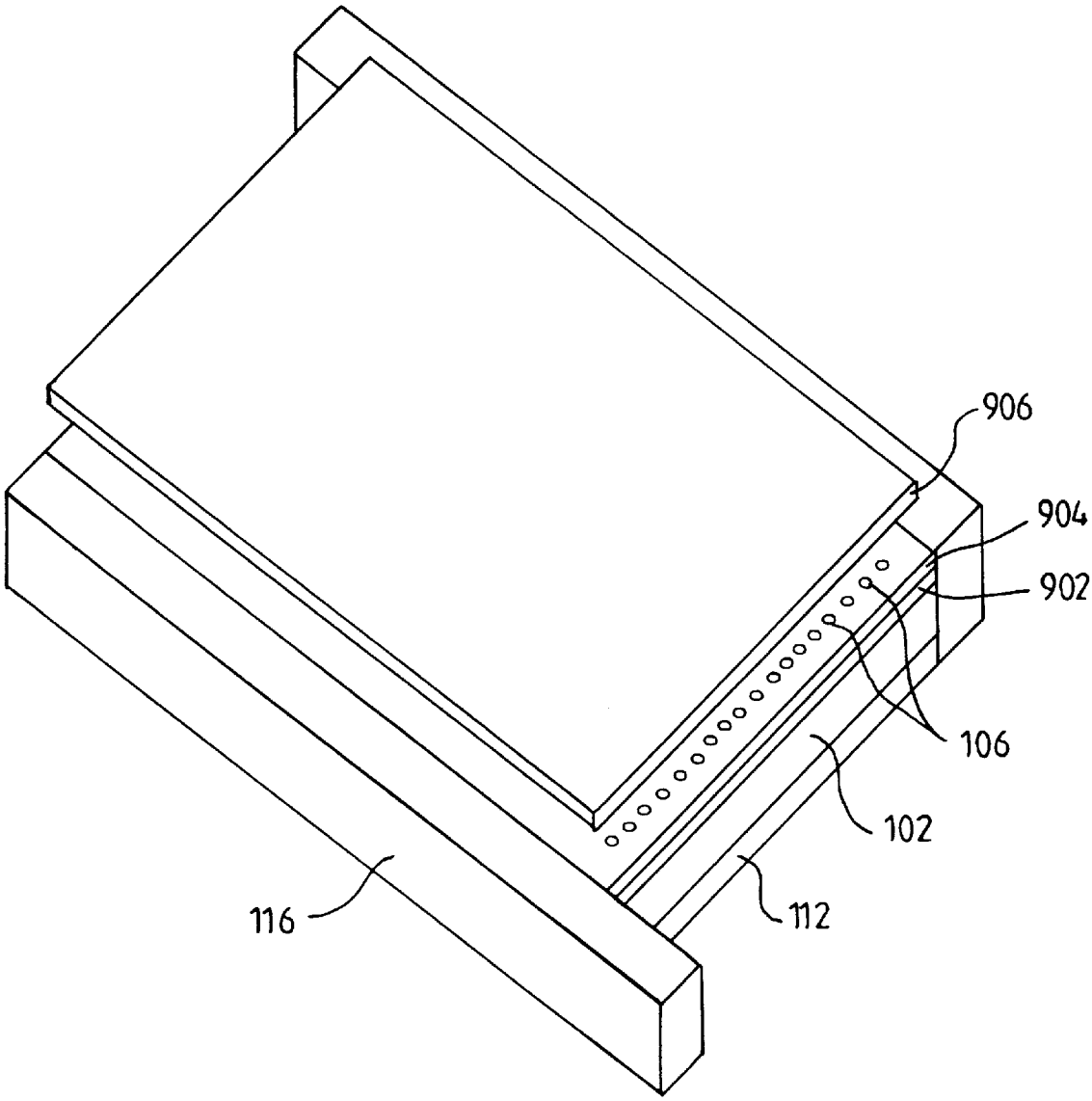
FIG. 15 is an isometric view of a variation of the magnetic channel cathode of FIG. 1, in which two perforated ceramic plates are placed over the cathode.

FIG. 15 shows an alternative to the Magnetic Matrix Display, in which two perforated ceramic plates 902, 904, each having a conducting surface, are placed over the cathode. These plates 902, 904 form a simple electrostatic focus lens for each aperture 106. A screen 906 coated with FED type low voltage phosphors is placed close to the plates 902, 904. The conductive surface of the top ceramic plate 904 can also be etched into a stripe pattern, to incorporate colour selection by the micro beam steering method used in a Magnetic Matrix Display and disclosed in UK Patent Application 2304981. If FED low voltage phosphors working at less than 1kV are used, then two ceramic plates 902, 904, each 0.4 mm thick with powder blasted tapered holes can be used to space the phosphor plate 906 from the cathode (in a similar manner to the Philips Zeus construction), leading to a self supporting display less than 5 mm thick.

Manufacturing methods

The two magnetic plates necessary for the manufacture of a specific embodiment of the invention, that is a 16' (406.4 mm) viewable diagonal display with pixels on 0.3 mm centres will now be described.

First plate (102)

A 0.6 mm thick magnet 265×318 mm is needed, which can be ferrite, glass bonded ferrite, metal or glass bonded metal magnet material. This magnet 102 must be grooved down the short dimension with 0.225 mm wide grooves on 0.3 mm centres, a total of 1024 grooves. The depth of each groove should be 0.225 mm. This produces grooves having a cross-section of 0.225×0.225 mm. The grooves are a substantially constant cross-section along their length. The material used for the first magnetic plate is conventional and the flat ungrooved plate may be made by standard mass production techniques from wet slurry pressing or green-sheet doctor blading followed by sintering. Alternatively, a grooved doctor blade may be used to produce the plate directly followed by a zero shrinkage sintering process. If a plain sintered plate is produced then the grooves may be produced by powder blasting or grinding, such as is described in "Glass and glass machining in Zeus panels", Ligthart et al, Philips J. Res. 50 (1996), pp475–499, both of which are known processes. Photoetching of the magnet plate may also be used. The channel aspect ratio of 1:1 makes any such processing simple to implement, and higher aspect ratios could be produced and used if required. A non magnetic stainless steel plate 112 can advantageously be attached to the ungrooved surface of the plate 102 to give increased tensile strength.

Second plate (104)

A 0.075 mm thick magnet 265×318 mm, is required, which is also ferrite, glass bonded ferrite, metal or glass bonded metal magnet material. The second plate 104 must be perforated with 0.15 mm diameter apertures all over at the pixel pitch of 0.3 mm. There is a 10 mm strip at the top and at the bottom of the second plate 104 which is left unperforated. The holes may be produced by punching at the greensheet stage followed by sintering in a zero shrinkage sintering process, or by powder blasting a fully sintered blank. These are known processes. A photoetching process could also be used. The aperture aspect ratio of 2:1 diameter to depth is easily produced by any of these processes. The perforated plate is extremely fragile but existing production processes developed for handling large thin glass sheets in the LCD industry (usually based on air cushion beds) can be used.

Coating

Each plate 102, 104 must be coated on one surface with a thin conductive film. Existing aluminium sputtering processes are suitable for this.

Assembly

The two plates 102, 104 are now brought together, aligned (either visually or via tooling holes) and bonded together with glass frit. Alternatively, the plates 102, 104 may be bonded together using ultrasonic welding between the aluminium coating at specific points. Once the plates are bonded together the resulting laminate is no longer fragile and the structure is strong, especially if a stainless steel backing 112 is used for the first sheet 102.

Magnetisation

The structure described above is made in an unmagnetised state, to prevent contamination by magnetic attraction of fine particles floating in the atmosphere. After assembly it must be magnetised with the North-South orientation shown in FIG. 1. This has the problem that the structure must be placed in a magnetic field sufficiently strong to orient the magnet domains, and over a distance of over 250 mm. To avoid an excessively large magnetising magnet being necessary, the structure is heated to a temperature close to the Curie point of the magnetic material, when only a very weak field is needed to orient the domains. When cooled to a little below this temperature the domains are locked in place and the assembly can be removed to complete its cooling.

External magnetic fields

External fields emanating from the structure are in the same direction as the channels and are therefore vertical if the channels are vertical (which would the usual situation). Fields in this direction tend to shift the picture horizontally. If the fields are strong enough to cause a visible effect on the screen, then the shift can be compensated by an offset on the micro beam steering deflection anodes. Alternatively, a shielding plate of moderate permeability (say mu=10 to 100) placed above the cathode shunts most of the field away without causing any appreciable effect on the magnetic field in the channels. The top plate 104 of the magnet could be magnetic stainless steel to achieve this.

Emission control

A problem in using multiple emission sources, or long filaments, is that the electron emission may not be uniform. This has been recognised in other displays of this type, and it has become usual to incorporate stabilisation by monitoring and controlling the emission current. "Triodes for Zeus displays", Montie et al, Philips J. Res. 50 (1996), pp281–293. discloses applied channel emission control in Philips' Zeus display. The Magnetic Channel Cathode allows for emission control by virtue of the fact that the current from each electron source is all absorbed by the channel walls during the display blanking periods. By arranging the conductive coating of each channel to be separate, connection can be made (preferably via a multiplexer) to a sampling circuit during, for example, horizontal or vertical blanking, and the emission current value digitised and stored. Since current changes in the sources are always slow it is only necessary to sample the current intermittently. The stored value can then be used to control emission by altering the voltage on the cathode (in the case of a thermionic source), the device current (in the case of a semiconductor source) or the voltage on a control grid.

What is claimed is:

1. An electron source comprising a first permanent magnet having a first channel, extending between first and second poles of the magnet, the internal surfaces of the first channel being conductive, a cathode located in the first channel at a first pole of the magnet, a potential being applied between the cathode and the conductive internal surfaces of the first channel causing electrons to be received into the first channel, and a plurality of apertures located on a wall of the first channel, the wall abutting a second permanent magnet having a plurality of second channels extending between first and second poles of the second magnet, the second pole of the second magnet being adjacent to the apertures located on said wall of the first magnet, such that electrons received into the first channel are distributed into the plurality of second channels.

2. An electron source as claimed in claim 1, wherein regions of the internal conducting surfaces of the first channel are isolated, the isolated regions having voltages applied to them to create electrostatic lenses for the purpose of directing the electrons at junctions between the first channel and the plurality of second channels.

3. An electron source as claimed in claim 1, wherein the internal surfaces of each of the second channels are conductive, each of the second channels having a plurality of perforations located on a first surface of the second magnet, the surface extending between opposite poles of the magnet, wherein each perforation forms electrons received from the cathode means into an electron beam for guidance towards a target.

4. An electron source as claimed in claim 3, further comprising a third permanent magnet having a third channel, extending between first and second poles of the magnet, the internal surfaces of the third channel being conductive and a plurality of apertures located on a wall of the third channel, the wall abutting the second magnet, the first pole of the second magnet being adjacent to the apertures located on said wall of the third magnet.

5. An electron source as claimed in claim 4 further comprising a cathode located in the third channel at a second pole of the third magnet, a potential being applied between the cathode and the conductive internal surfaces of the third channel causing electrons to be received into the third channel.

6. An electron source as claimed in claim 3, wherein the second channels are arranged at a pitch corresponding to the pixel pitch of a display incorporating the electron source.

7. An electron source as claimed in claim 3, wherein each second channel has a constant cross-section along its length.

8. An electron source as claimed in claim 3 wherein each channel is quadrilateral in cross-section.

9. An electron source as claimed in claim 8 wherein each channel is square in cross-section.

10. An electron source as claimed in claim 3, wherein the perforations are disposed in the magnet in a two dimensional array of rows and columns.

11. An electron source as claimed in claim 3, wherein the perforations are arranged at a pitch corresponding to the pixel pitch of a display incorporating the electron source.

12. An electron source as claimed in claim 3, wherein each of said channels is unperforated for a distance from the first channel of ten or more times the pitch of the perforations.

13. An electron source as claimed in claim 3, further comprising a stainless steel plate located on the surface of the magnet furthest from the perforations.

14. An electron source as claimed in claim 3, wherein the conducting surfaces associated with each of the channels are electrically separated.

15. A display device comprising: an electron source as claimed in claim 3; a screen for receiving electrons from the electron source, the screen having a phosphor coating facing the side of the magnet having perforations; two perforated ceramic plates, each having a conductive surface, so as to cause a flow of electrons from the cathode to the phosphor coating via the channels and perforations thereby to produce an image on the screen.

16. An electron source as claimed in claim 1, wherein the second magnet comprises a first magnetic plate having grooves, extending between opposite poles of the magnet, along a first surface of the first magnetic plate, and a second magnetic plate having a plurality of perforations, said second plate being located so as to close the grooves to form the plurality of second channels, the second channels having perforations located on a surface extending between opposite poles of the second magnet.

17. An electron source as claimed in claim 16, wherein the first magnetic plate is at least twice as thick as the channel depth.

18. An electron source as claimed in claim 17, wherein each channel has a depth greater than the width of the channel and wherein the portion of the channel furthest from the perforations is curved in cross-section.

* * * * *